United States Patent [19]

Coppage, Jr. et al.

[11] Patent Number: 5,008,959

[45] Date of Patent: Apr. 23, 1991

[54] BULLETPROOF DRESS SHIRT

[76] Inventors: Edward A. Coppage, Jr., 3031 Borge St., Unit 109, Oakton, Va. 22124; Richard W. Coppage, 14607 Batavia Dr., Centreville, Va. 22020

[21] Appl. No.: 486,374

[22] Filed: Feb. 28, 1990

[51] Int. Cl.[5] ..... F41H 1/00; A41D 13/00; A41D 1/04

[52] U.S. Cl. ..... 2/2.5; 2/2; 2/103

[58] Field of Search ..... 2/2, 2.5, 49 R, 53, 2/54, 272, DIG. 7, 103; 604/358, 367

[56] References Cited

U.S. PATENT DOCUMENTS

| | | | |
|---|---|---|---|
| 2,954,563 | 10/1960 | De Grazia | 2/2.5 |
| 3,155,985 | 11/1964 | Gallagher | 2/103 |
| 3,158,872 | 12/1964 | Pantzke | 2/103 |
| 3,557,384 | 1/1971 | Barron et al. | 2/2.5 |
| 3,873,998 | 4/1975 | Norris et al. | 2/2.5 |
| 4,079,464 | 3/1978 | Roggin | 2/2.5 |
| 4,183,097 | 1/1980 | Mellian | 2/2.5 |
| 4,200,677 | 4/1980 | Bottini et al. | 2/2.5 |
| 4,466,135 | 8/1984 | Coppage | 2/2.5 |
| 4,507,802 | 4/1985 | Small | 2/2.5 |
| 4,522,871 | 6/1985 | Armellino, Jr. et al. | 2/2.5 |
| 4,535,478 | 8/1985 | Züfle | 2/2.5 |
| 4,578,821 | 4/1986 | Züfle | 2/2.5 |
| 4,613,535 | 9/1986 | Harpell et al. | 2/2.5 |
| 4,737,401 | 4/1988 | Narpell et al. | 2/2.5 |
| 4,774,724 | 10/1988 | Sacks | 2/2.5 |
| 4,891,846 | 1/1990 | Sager et al. | 2/49 |

FOREIGN PATENT DOCUMENTS

| | | | |
|---|---|---|---|
| 2212710 | 8/1989 | United Kingdom | 2/49 |

*Primary Examiner*—Werner H. Schroeder
*Assistant Examiner*—Gloria Hale
*Attorney, Agent, or Firm*—Sherman and Shalloway

[57] ABSTRACT

A bulletproof dress shirt is disclosed which incorporates the following features: ease of installation, adjustability and removability through the use of VELCRO fasteners; lightweight design and removable bulletproof pads for ease in laundering; optional vital area protection; and design resembling a dress shirt so as to prevent other persons from discovering the fact that the garment is bulletproof, which design includes snap fasteners to permit attaching the dress shirt front over the top of shoulder straps attached by the aforementioned VELCRO fasteners, to prevent detection of the shoulder straps. Additionally, means to improve comfort by absorption of perspiration are included.

16 Claims, 3 Drawing Sheets

FIG. 1
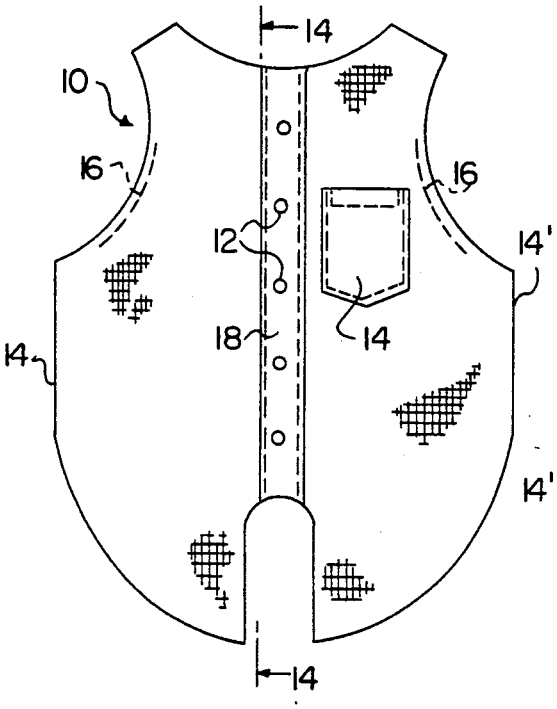
FIG. 2
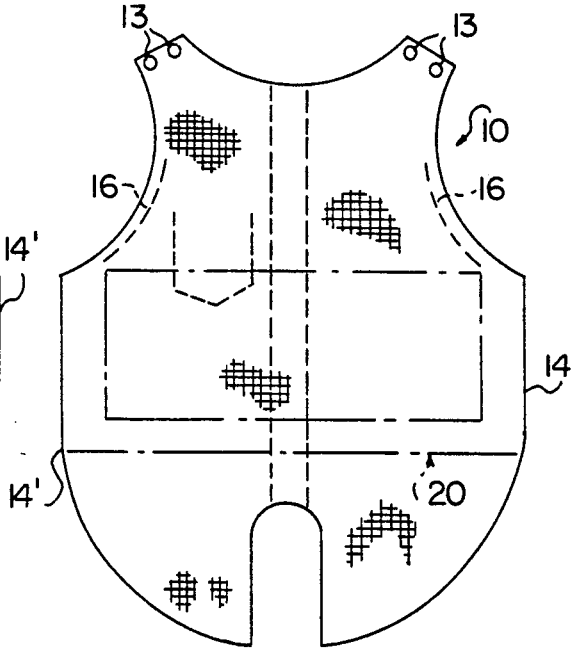
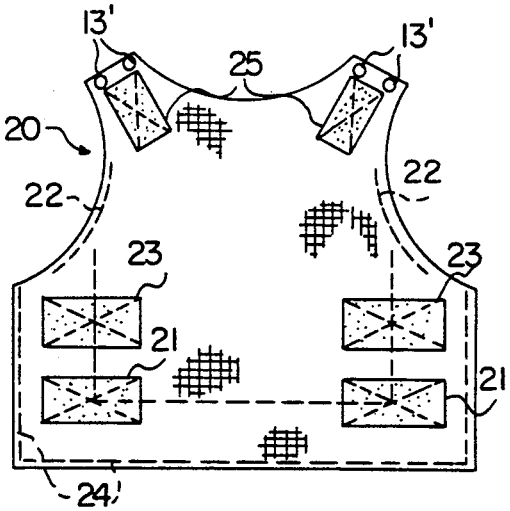
FIG. 3
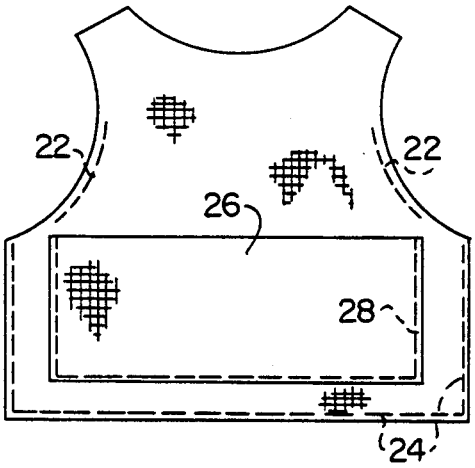
FIG. 4

BULLETPROOF DRESS SHIRT

BACKGROUND OF THE INVENTION

This invention relates to a bullet proof dress shirt useful in protecting the torso of a man or woman, particularly those persons engaged in military or law enforcement activities.

Prior bullet proof garments, while showing effectiveness against penetration of bullets, have been beset with problems of fit and comfort. Just as troublesome has been the problem of bulkiness in prior designs which has made it quite difficult to conceal the fact that one is wearing a bullet proof garment. The following patents are good examples of the problems attendant in prior art designs:

1. U.S. Pat. No. 4,079,464 to Roggin which shows a bullet proof vest with hook and pile connections on each side to allow easy fastening but lacks any adjustment in the shoulderneck area, and is quite bulky and uncomfortable to wear.

2. U.S. Pat. No. 3,973,275 to Blauer which shows a vest in which the front portion is composed of two parts releasably connected with hook and pile fasteners but lacks any adjustability in the neck area, utilizes uncomfortable elastic bands 42, 44 to conform to the user and does not include removable bullet proof pads or resemble a shirt.

3. U.S. Pat. No. 3,803,639 to Cohen which shows adjusting clasps 10 and 12 which are quite cumbersome to adjust and/or release.

4. U.S. Pat. No. 4,183,097 to Mellian discloses a body armor garment for women which has a very stiff back plate was well as hook and pile fasteners 29, 30 enabling the armor panels to be removed. Its major shortcomings include the fact that it is worn under the clothing and doesn't resemble an ordinary shirt or blouse.

5. U.S. Pat. No. 3,557,384 to Barron, et al. shows an armored vest which is disclosed as weighing "in excess of 20 lbs." and as such must be assumed to have never contemplated the concept of a lightweight bulletproof dress shirt.

6. U.S. Pat. No. 3,452,362 to Korolick, et al. is similar to Barron, et al. in that it discloses a heavy cumbersome vest which is designed with no regard for use as a lightweight dress shirt.

7. U.S. Pat. No. 4,266,297 to Atkins which shows a bullet resistant shirt-like garment. The front receptacle for the ballistic panel is formed by two portions on opposite sides of button fasteners 8 which overlap when the shirt is buttoned to form the entire receptacle. This construction is awkward in that it is difficult to insert the front ballistic panel when the shirt is unbuttoned and equally difficult to do so when the shirt is buttoned up while being worn.

8. U.S. Pat. No. 4,466,135 to Coppage, the inventor herein, shows a bulletproof dress shirt formed of front and back panels connected by hook and pile fasteners with the front portion made to resemble a dress shirt. Both the front and back panels incorporate integral pockets to accept removable bulletproof pads. This shirt is designed to be worn over a normal dress shirt with the collar and tie of that shirt protruding over the bullet proof shirt and is made of standard light weight dress shirt material which, even though comfortable, has no provision for coping with added perspiration occasioned by the tight and relatively non-breathable ballistic material of the bulletproof pads.

Summary of the Invention

The bulletproof dress shirt of the present invention is an improvement over the prior art, including the present inventor's own U.S. Pat. No. 4,466,135, and overcomes the above noted deficiencies in the prior art garments through its unique combination of the following features:

1. Hook and pile fasteners connect the front of the shirt to the back of the shirt, both on the sides and at the area of the neck and shoulders to make it more easily adaptable to different sized individuals.

2. The front of the shirt is made to resemble a dress shirt, and when worn over a standard dress shirt with the collar and necktie from the standard dress shirt protruding over the invention, the invention blends into the ensemble so as to become an integral part thereof.

Alternatively, the shirt may be worn with a separate collar dickey corresponding in style to the front of the bulletproof shirt, thereby relieving the wearer of the added layer of a full dress shirt underneath.

3. The invention is made of a standard lightweight dress shirt material such as oxford cloth and includes inner layers on the front and back panels of the shirt that are made of a bi-component material to draw perspiration away from the wearer and as such, provides a far more comfortable article of apparel.

4. The invention incorporates integral closable pockets in the front and back of the shirt which retain in position removable bulletproof pads made of a material consisting of a series of layers of fabric which may be made of aramid polymer yarn such as a fabric known by the trademark KEVLAR and manufactured by E.I. DuPont de Nemours and Company, but are preferably made of a plurality of layers of woven and non-woven ultrahigh molecular weight extended chain polyethylene known by the tradenames SPECTRA and SPECTRA SHIELD manufactured by Allied-Signal Corporation.

5. The front of the shirt may also include an additional layer of fabric which includes a pocket adapted to enclose an optional bulletproof "vital area pad", the orientation and location of which may be adjusted for a particular situation.

6. All bulletproof pads are removable so that the shirt may be laundered routinely.

7. The separability of the front and back of the shirt enables substitution of different front portions of diverse colors, styles, etc.

8. The invention incorporates a method of attaching and unattaching the dress front layer to the middle layer of the vest by means of snap fasteners which permit the shirt to be fastened over the shoulders by straps while hiding the straps from view underneath the attachable dress shirt front.

BRIEF DESCRIPTION OF THE DRAWING FIGURES

FIGS. 1 and 2 show front and rear views, respectively, of the outer layer of the front panel of the shirt.

FIGS. 3 and 4 show front and rear views, respectively, of the middle layer of the front panel of the shirt.

Figure 5:
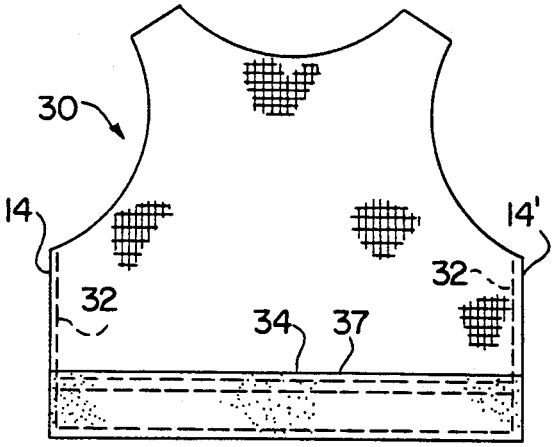
FIGS. 5 and 6 show front and rear views, respectively, of inner layer of the front panel of the shirt.
Figure 11:
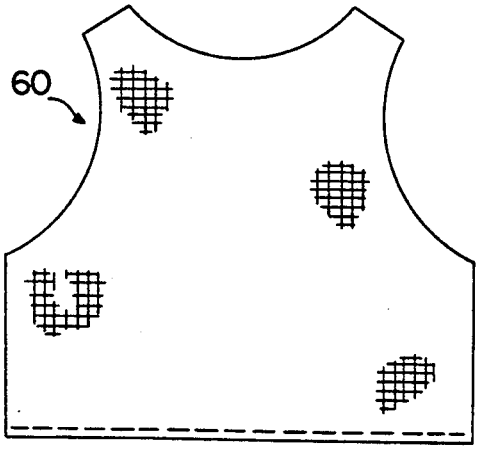
FIGS. 11, 12 and 13 show, respectively, the front, rear and "vital area" bulletproof pads.
Figure 13:
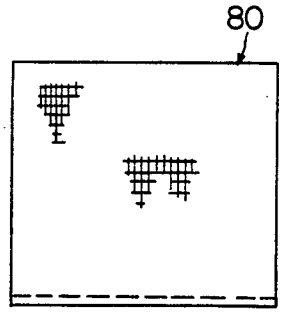
Figure 14:
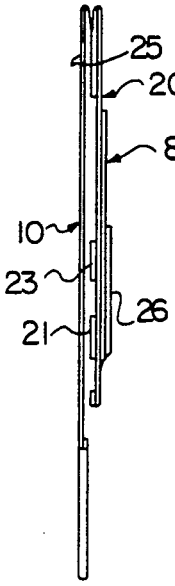

FIG. 14 shows a view taken along line 14—14' of FIGS. 1, 3 and 5 showing the pads of FIGS. 11 and 13 in place in the assembled front panel.

Figure 9:
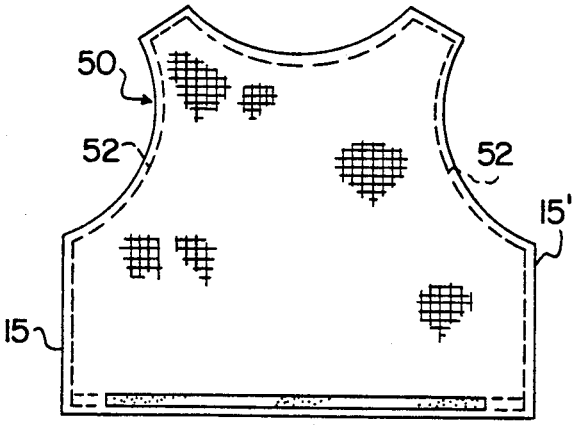
FIGS. 9 and 10 show front and rear views, respectively, of the inner layer of the rear panel of the shirt.
Figure 12:
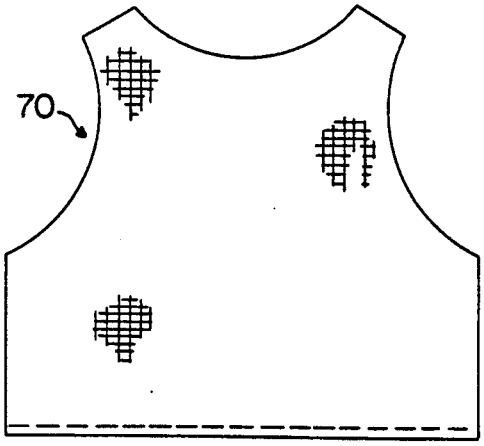
Figure 7:
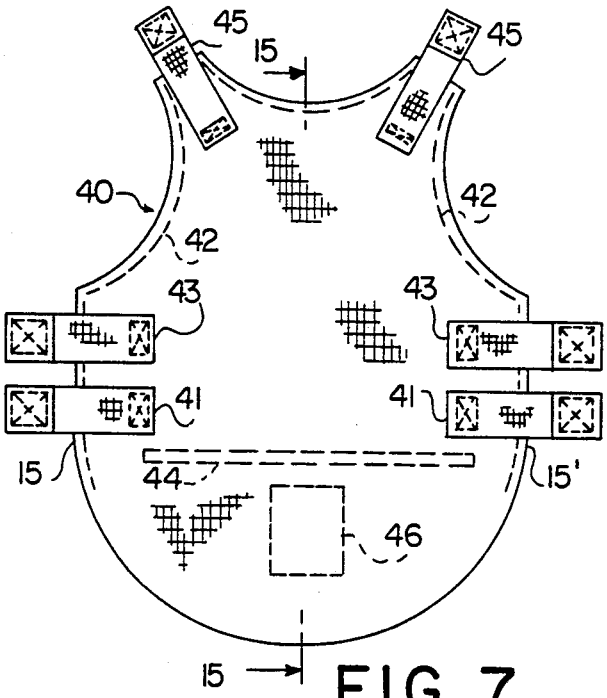
FIGS. 7 and 8 show front and rear views, respectively, of the outer layer of the rear panel of the shirt.
Figure 15:
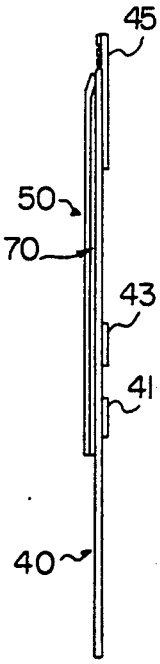

FIG. 15 shows a view taken along line 15—15' of FIGS. 7 and 9 showing the pad of FIG. 12 in place on the assembled shirt.

Figure 16:
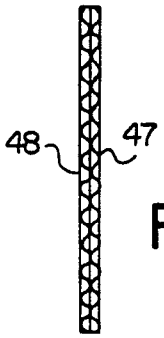

FIG. 16 shows a representative cross-section of the inner layers of the front and rear panels.

DETAILED DESCRIPTION OF THE PREFERRED EMBODIMENT

Referring to FIGS. 1-6, it is apparent that the front panel of the shirt is formed in three layers, 10, 20 and 30. The outer layer 10 is that layer of the shirt that will be visible on the wearer. Layer 10 includes buttons 12, a pocket 14 and areas of stitching 16 which attach the layer 10 to the layer 20. In the preferred embodiment, the buttons appear to be retained by button holes (not shown), but the portion 18 of the shirt does not open; it is merely designed to give the appearance of a buttoning dress shirt. The pocket 14 is functional, however, and may be used by the wearer to store miscellaneous items.

Middle layer 20 includes stitching areas 22 which attach the middle layer to the front layer and stitching areas 24 which attach the middle layer to the inner layer 30. Referring particularly to FIG. 3, hook and pile fastening material 21, 23, 25 is attached to the front of the middle layer for a purpose to be described hereinafter. FIG. 4 shows the back of the middle layer 20 which includes an optional pocket 26 sewn thereon by stitching 28. The size and orientation of pocket 26 may be varied as desired for particular individuals' individual requirements. Referring back to FIGS. 2 and 3, mating snap fasteners 13, 13' are provided on outer and middle layers 10, 20 for a purpose to be described hereinafter.

Figure 6:
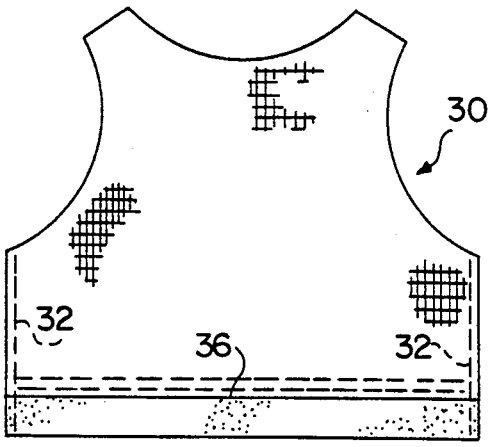

Referring to FIGS. 5-6, the inner layer 30 of the front panel is shown. The inner layer 30 includes stitching 32 which attaches the inner layer 30 to the middle layer 20 and hook and pile fastening means 34, 36 to close an opening 37.

The front panel is assembled by stitching the stitching areas 12, 22, 24, 32 together as described above. When assembled, the middle and inner layers form a front panel containment area accessible by the noted opening in the inner layer.

FIGS. 7-10 depict the outer and inner layers of the rear panel of the shirt.

Figure 8:
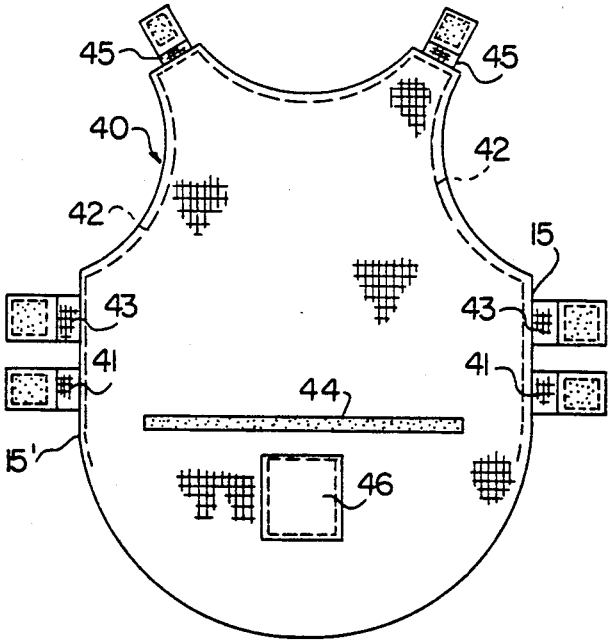

Referring specifically to FIGS. 7-8, the outer layer 40 of the rear panel is shown. The outer layer 40 includes hook and pile type fasteners 41, 43, 45 for a purpose to be described hereinafter. Stitching 42 is provided to enable attachment of the outer layer to the inner layer. Hook and pile fastening material 44 is attached to the back of the outer layer as is a label 46 listing washing instructions.

Figure 10:
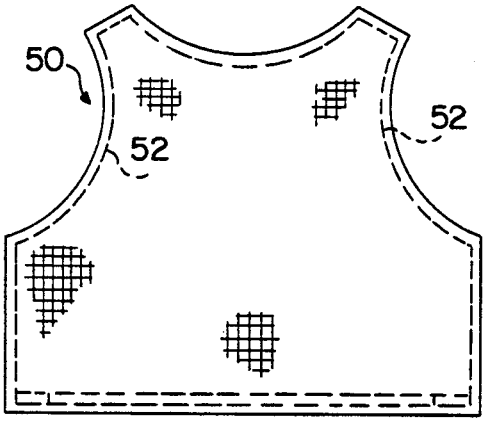

Referring to FIGS. 9-10, the inner layer 50 of the rear panel includes stitching 52 to enable attachment of the inner layer 50 to the outer layer 40 and hook and pile fastening material 54 attached to the front thereof and located so as to mate with hook and pile fastening material 44.

The rear panel is assembled by stitching the stitching areas 42, 52 together as described above. When assembled, the inner and outer layers form a rear panel containment area accessible by separating the hook and pile fasteners 44, 54.

The inner layer 30 of the front panel and the inner layer 50 of the rear panel form the surfaces that rest against the body of the wearer. Although the shirt, for the most part, is made of a standard dress shirt material such as oxford cloth which is by nature breathable and allows perspiration to evaporate, the bulletproof pads retard the passage of such perspiration allowing it to build up and thereby reduce the comfort of the wearer.

Accordingly, an improvement to the shirt of the inventor's prior patent, and indeed to other prior art garments of this type, comprises inner layers 30 and 50 which are made of a bi-component material designed to draw perspiration away from the body of the wearer leaving a substantially dry and comfortable surface innermost on the shirt.

Referring to FIG. 16, a representational cross-section of inner layers 30 and 50 is shown. These layers are made of a bi-component material, which may be woven or non-woven, and which comprises a hydrophobic layer 47 and a hydrophilic layer 48. The material is oriented in the garment so that the hydrophobic layer 47 is inner most, to be against the wearer's body, with the hydrophilic layer 48 backing it up. In operation, as the wearer of the shirt perspires, the hydrophilic layer 48 acts to draw the perspiration through the hydrophobic layer 47 and away from the wearer's body. The hydrophobic layer 47 remains dry against the wearer presenting a more comfortable inner surface to the garment.

While any bi-component material having the hydrophobic and hydrophilic properties may be used, a preferred material is a bi-component nylon fabric available from Allied-Signal Corporation under the name HYDROFIL. Furthermore, if additional strength is needed, the bi-component material may have a layer of standard dress shirt material stitched to one or both sides of the bi-component material.

Referring to FIGS. 11, 12 and 13, the bulletproof pads 60, 70 and 80 are shown. These pads may be made of a series of layers of fabric made of aramid polymer yarn, preferably a fabric known by the trademark KEVLAR and manufactured by E. I. DuPont de Nemours and Company. However, it is known that when KEVLAR gets wet the fibers become lubricated allowing a projectile to push them apart and slip through the material. In fact, when saturated, KEVLAR fabric looses upwards of 34% of its stopping ability. Thus, although KEVLAR pads may be used in the improved bulletproof shirt of this invention, the inventor herein has found a material that is better suited to use in such garments and particularly in the garment of this invention which includes the bi-component perspiration absorbing layers.

The bulletproof pads 60, 70 and 80 are preferably made of a series of layers of an ultrahigh molecular weight extended chain polyethylene fabric. This material is available in fiber form to be woven and in the form of unidirectional non-woven pads from Allied-Signal Corporation under the names SPECTRA FIBER and SPECTRA SHIELD, respectively. Both the woven and non-woven forms exhibit ballistic stopping capability; however, the non-woven form is superior in this capacity. Although it is a superior bulletproof material, the non-woven form is stiff and uncomfortable whereas the woven form, particularly when the fiber is in the range of 185 denier to 500 denier, is extremely comfortable. The inventor herein has found that by combining the two forms of ultrahigh molecular weight extended chain polyethylene material a synergy occurs which greatly increases the ballistic stopping capability of the woven form yet at the same time increases the comfort level of the unidirectional non-woven form.

Accordingly, it is preferred that the bulletproof pads, 60, 70 and 80 be made of a series of layers of ultrahigh molecular weight extended chain polyethylene material, with a portion of these layers being in the form of a unidirectional non-woven pad and a portion being in the form of a fabric of woven fibers of the polymer. Preferably, the woven fibers will be in the range of 185 denier to 500 denier. The specific ratio of woven to non-woven layers will depend on both the denier of the fibers and the desired protection level. A preferred range for a standard level of protection and a fiber of 215 denier is from 1:1 to 2:3 woven layers to non-woven layers.

Pad 60 is inserted into the front panel containment area through the opening 37 defined by the fastening means 34, 36; pad 70 is inserted into the rear panel containment area through the opening defined by fastening means 44, 54. If desired, vital area pad 80 may be inserted into pocket 26 to provide additional protection.

In the preferred embodiment, the hook and pile fastening means described above comprise a material sold under the trademark VELCRO. The separate hook and pile portions of the VELCRO fastener may be placed, as desired, on either of the two elements which are being fastened together.

The front panel is attached to the rear panel in the following manner; snaps 13, 13' are unfastened and with the inner layer of the rear panel facing the inner layer of the front panel, the hook and pile fasteners of the front and rear panels are connected together with fasteners 21 connected to fasteners 41, fasteners 23 connected to fasteners 43 and fasteners 25 connected to fasteners 45. Each of the fasteners is made longer than would ordinarily be necessary to retain the panels together so that adjustability of the fit of the shirt is possible. After the fasteners 25, 45 are connected, snaps 13, 13' are fastened.

If it is desired that the garment be laundered, the pads 60, 70 and 80 are removed and the shirt is laundered following the instructions on label.

Although the bulletproof shirt of this invention may be worn over a normal dress shirt with the collar thereof protruding over the invention, in view of the improvement comprising the bi-component inner layers, it now is possible to wear the shirt merely with an appropriate dickey providing a collar conforming to the style of the front panel, whether that of a man's shirt or a woman's blouse. This manner of wearing provides added comfort by eliminating the extra layer of a full dress shirt underneath the bulletproof shirt.

The owner of the shirt may own several different front panels of diverse colors, styles, etc. so that the protection from attack as well as aesthetic satisfaction may be achieved.

It will be understood that various changes in the details, materials and arrangements of parts which have been herein described and illustrated in order to explain the nature of the invention may be made by those skilled in the art, and that it is intended that the invention be limited only by the limitations of the following claims.

What is claimed is:

1. A bulletproof shirt comprising: a front panel and a rear panel and connecting means releasably attaching said front panel to said rear panel;

said front panel including:

(a) an outer layer including means incorporated thereon causing said outer layer to resemble a shirt;

(b) a middle layer including a portion of said connecting means;

(c) an inner layer including a first opening bounded by first and second means releasably fastening said opening in a closed configuration;

(d) said outer layer being permanently fastened to said middle layer at one location and said middle layer being permanently fastened to said inner layer to form a front panel containment area between said inner and middle layers accessible through said first opening;

said rear panel including:

(a) an outer layer including a portion of said connecting means and further including third releasable fastening means;

(b) an inner layer including fourth releasable fastening means engageable by said third releasable fastening means;

(c) said inner and outer layers of said rear panel being permanently fastened together so that said third and fourth releasable fastening means engage one another and provide closable access to a rear panel containment area formed between said layers;

said inner layers of said front and rear panel comprising a bi-component fabric having hydrophobic and hydrophilic capabilities;

said shirt further including removable bulletproof pads, a first said pad being removably inserted into said front panel containment area and a second said pad being removably inserted into said rear panel containment area; said pads each comprising a series of layers of woven and non-woven ultrahigh molecular weight extended chain polyethylene material, said woven layers comprising fibers of from 185 denier to 500 denier and said non-woven layers being unidirectional pads;

said front and rear panels being assembled to one another by engagement of said connecting means in said panels.

2. The bulletproof shirt of claim 1, wherein said middle layer of said front panel further includes a pocket formed thereon.

3. The bulletproof shirt of claim 2 wherein a third bulletproof pad is removably placed in said pocket.

4. The bulletproof shirt of claim 1 wherein said connecting means includes hook and pile type fasteners.

5. The bulletproof shirt of claim 1 wherein said connecting means includes two pairs of interconnecting hook and pile type fasteners on each side of said front and rear panels and further includes one pair of interconnecting hook and pile fasteners, one to each side of the area of the shirt where the neck of the person wearing the shirt protrudes.

6. The bulletproof shirt of claim 5, wherein each of said hook and pile type fasteners is made sufficiently long so as to permit adjustability of the size of the shirt.

7. The bulletproof shirt of claim 1, wherein said means causing said outer layer of said front panel to resemble a shirt includes pocket means and a series of buttons appearing to protrude through button holes.

8. The bulletproof shirt of claim 1 wherein said first, second, third and fourth releasable fastening means comprise hook and pile type fasteners.

9. The bulletproof shirt of claim 1 wherein said one location where said outer layer of said front panel is permanently fastened to said middle layer of said front panel comprises side portions of said outer and middle layers and further wherein said outer and middle layers are removably attached to one another at top portions thereof.

10. The bulletproof shirt of claim 9 wherein snap fasteners removably attach said top portions together.

11. The bulletproof shirt of claim 1, wherein said inner layers of bi-component fabric comprise a layer of hydrophobic material and a layer of hydrophilic material, said layers being of equivalent size and shape and arranged one over the other.

12. The bulletproof shirt of claim 11, wherein said inner layers of bi-component fabric are permanently fastened to their respective middle and outer layers such that the layer of hydrophobic material in each bi-component layer forms the innermost layer of the garment to be against the body when the shirt is worn.

13. The bulletproof shirt of claim 1 in combination with a dickey of a style corresponding to that of the means causing the said outer layer of said front panel to resemble a shirt.

14. The bulletproof shirt of claim 1, wherein said inner layers of bi-component fabric comprise a bi-component nylon fabric having an inner layer of hydrophobic capability and an outer layer of hydrophilic capability, said inner layers of bi-component fabric being attached to their respective panels of said shirt such that the hydrophobic layer forms the innermost layer of each panel.

15. The bulletproof shirt of claim 1, wherein said bulletproof pads comprise a plurality of said woven and non-woven layers in a ratio of from 1:1 to 2:3 woven:-non-woven layers.

16. A bulletproof shirt comprising: a front panel and a rear panel and connecting means releasably attaching said front panel to said rear panel;

said front panel including:

(a) an outer layer including means incorporated thereon causing said outer layer to resemble a shirt;

(b) a middle layer including a portion of said connecting means;

(c) an inner layer including a first opening bounded by first and second means releasably fastening said opening in a closed configuration;

(d) said outer layer being permanently fastened to said middle layer at one location and said middle layer being permanently fastened to said inner layer to form a front panel containment area between said inner and middle layers accessible through said first opening;

said rear panel including:

(a) an outer layer including a portion of said connecting means and further including third releasable fastening means;

(b) an inner layer including fourth releasable fastening means engageable by said third releasable fastening means;

(c) said inner and outer layers of said rear panel being permanently fastened together so that said third and fourth releasable fastening means engage one another and provide closable access to a rear panel containment area formed between said layers;

said shirt further including removable bulletproof pads, a first said pad being removably inserted into said front panel containment area and a second said pad being removably inserted into said rear panel containment area;

said front and rear panels being assembled to one another by engagement of said connecting means in said panels;

the improvement comprising:

said inner layer of said front panel comprising a bi-component nylon fabric having a hydrophobic inner layer and a hydrophilic outer layer and being permanently fastened to said middle layer of said panel such that said hydrophobic layer forms the innermost layer of said panel;

said inner layer of said rear panel comprising a bi-component nylon fabric having a hydrophobic inner layer and a hydrophilic outer layer and being permanently fastened to said outer layer of said panel such that said hydrophobic layer forms the innermost layer of said panel; and said bulletproof pads each comprising a plurality of layers of ultrahigh molecular weight extended chain polyethylene, said layers comprising woven fibers of said polyethylene and unidirectional non-woven pads of said polyethylene, said woven layers comprising fibers of from 185 denier to 500 denier.

* * * * *